US008720648B1

(12) United States Patent
Roys

(10) Patent No.: US 8,720,648 B1
(45) Date of Patent: May 13, 2014

(54) CHECK VALVE AND METHOD AND APPARATUS FOR EXTENDING LIFE OF CHECK VALVES

(75) Inventor: Curtis Roys, Midland, TX (US)

(73) Assignee: Coltec Industrial Products, LLC, Stafford, TX (US)

( * ) Notice: Subject to any disclaimer, the term of this patent is extended or adjusted under 35 U.S.C. 154(b) by 1538 days.

(21) Appl. No.: 11/411,424

(22) Filed: Apr. 26, 2006

Related U.S. Application Data

(60) Provisional application No. 60/675,142, filed on Apr. 27, 2005.

(51) Int. Cl.
*F16N 21/00* (2006.01)

(52) U.S. Cl.
USPC ..... 184/105.3; 184/6.23; 184/36; 285/124.5

(58) Field of Classification Search
USPC ..... 138/89, 104; 184/6, 6.28, 6.8, 6.9, 83, 184/85, 86, 105.3, 6.23, 6.16, 31, 36, 80; 251/142; 258/10; 277/318; 96/155, 96/163, 165, 204, 206; 285/124.1, 124.5, 285/122.1; 137/171
See application file for complete search history.

(56) References Cited

U.S. PATENT DOCUMENTS 302,343 A * 7/1884 Kitton ..... 285/356
339,251 A * 4/1886 Ames ..... 184/83
1,201,414 A * 10/1916 Winkley ..... 184/14
1,534,173 A * 4/1925 Fogelberg ..... 285/277
1,632,775 A * 6/1927 Bijur ..... 184/7.3
1,633,056 A * 6/1927 Wishart et al. ..... 418/66
1,640,600 A * 8/1927 Crosby ..... 73/710
1,664,733 A * 4/1928 Braun ..... 418/66
1,940,452 A * 12/1933 Glab ..... 137/513
1,949,639 A * 3/1934 Zimmerer ..... 96/163
2,048,323 A * 7/1936 Cutts, Jr. et al. ..... 184/7.4
2,241,718 A * 5/1941 Meixsell ..... 418/100
2,531,319 A * 11/1950 Briggs ..... 184/6.23
3,656,584 A * 4/1972 Lyden ..... 184/6
3,769,999 A * 11/1973 Flanagan et al. ..... 137/183
3,834,124 A * 9/1974 Ichikawa ..... 96/219
3,923,435 A * 12/1975 Jones ..... 418/100
5,025,762 A * 6/1991 Gohara et al. ..... 123/196 S
5,490,874 A * 2/1996 Kuster et al. ..... 96/204
5,835,372 A 11/1998 Roys et al.
6,779,558 B1 8/2004 Bruck et al.
6,893,485 B2 * 5/2005 MacDuff ..... 95/241
7,434,593 B2 * 10/2008 Noll et al. ..... 137/15.18

FOREIGN PATENT DOCUMENTS

GB 2117662 A * 10/1983

* cited by examiner

*Primary Examiner* — David D Le
*Assistant Examiner* — Terry Chau
(74) *Attorney, Agent, or Firm* — Perkins Coie LLP

(57) ABSTRACT

A device and method are described for extending the life of check valves. An improved check valve having a double poppet and tapered guides is more robust, and a check valve protection device between the check valve and the environment into which fluid is injected protects the valve from a contaminating or corrosive environment. The check valve and check valve protection device are small and light weight to prevent vibration-induced failures. The check valve protection device preferably has an interior volume that fills quickly by relatively few cycles of the lubricant pump to reduce delay of lubricant to the injection point.

21 Claims, 8 Drawing Sheets

CHECK VALVE AND METHOD AND APPARATUS FOR EXTENDING LIFE OF CHECK VALVES

This application claims priority from U.S. Prov. App. No. 60/675,142, filed Apr. 27, 2005, which is hereby incorporated by reference.

TECHNICAL FIELD OF THE INVENTION

The present invention relates to extending the life of check valves in hostile environments, and is particularly suitable for use in lubrication systems for natural gas compressors.

BACKGROUND OF THE INVENTION

Natural gas compressors receive natural gas from wells and compress the gas into compressed natural gas ("CNG"), which is more readily stored. Lubrication systems for natural gas compressors are described, for example, in U.S. Pat. No. 5,835,372 to Roys et al. To lubricate the compressor, a small volume of lubricant at high pressure is typically applied periodically into the compressor cylinder. A check valve inserted between the lubricant line and the compressor cylinder seals the compressor cylinder to prevent natural gas from flowing into the lubrication line. The high pressure lubricant periodically opens the valve to inject the lubricant. The lubricant is at a higher pressure than the natural gas, so when the valve is open, the lubricant flows into the cylinder, instead of the natural gas flowing out of the cylinder. To prevent the hot natural gas from contaminating or otherwise damaging the check valve, an oil reservoir device is typically mounted between the cylinder and the check valve to maintain an oil barrier between the check valve and the natural gas.

FIG. 1 shows a cross section of a typical reservoir device 100 mounted on a compressor 102 to provide an oil barrier between cylinder 104 and check valve 106. In operation, reservoir device 100 is filled with oil to the top of a tube 110 to ensure an oil barrier between check valve 106 and cylinder 104. The check valve 106 is typically connected to the reservoir using a nipple 116 having pipe threads 118 on both ends. The reservoir 100 is typically screwed into the top of the compressor 102 using NPT (national pipe tapered) pipe threads 120 and opens into cylinder 104. For many years, the compressor industry has been replacing failed compressor check valves without understanding the cause of the failure. Applicant has determined the cause of many check valve failures and the method and apparatus described below reduces check valve failures

SUMMARY OF THE INVENTION

An object of the invention is to reduce check valve failures and extend the life of lubricated equipment.

Embodiments of the invention reliable method to extend the life of not only gas compressor check valves, but of check valves in any application, particularly applications in which the valve is exposed to hot, corrosive, or contaminated fluids. This invention includes a device that provides a fluid barrier to protect check valves. In a preferred embodiment, the device has a small internal volume to prevent delaying lubricant from reaching the compressor upon start up as the device is filled.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more through understanding of the present invention, and advantages thereof, reference is now made to the following descriptions taken in conjunction with the accompanying drawings, in which.

DETAILED DESCRIPTION OF PREFERRED EMBODIMENTS

Applicant has found through his investigations of check valve failures in CNG compressors that check valves in compressors should preferably not be installed directly on the cylinder. Gas migrating into the check valve as it opens and closes can also create coking, that is, formation of carbon deposits from the lubricant, on the ball and seat of the check valve due to heat from the compressed gas or air. The coking causes premature failure of the valve. Vertical installation of the check valve allows the introduction of hot, contaminated gas into the check valve each time the valve opens to inject oil into the lubrication point, but failures can occur regardless of the orientation of the check valve on the cylinder.

Figure 1:
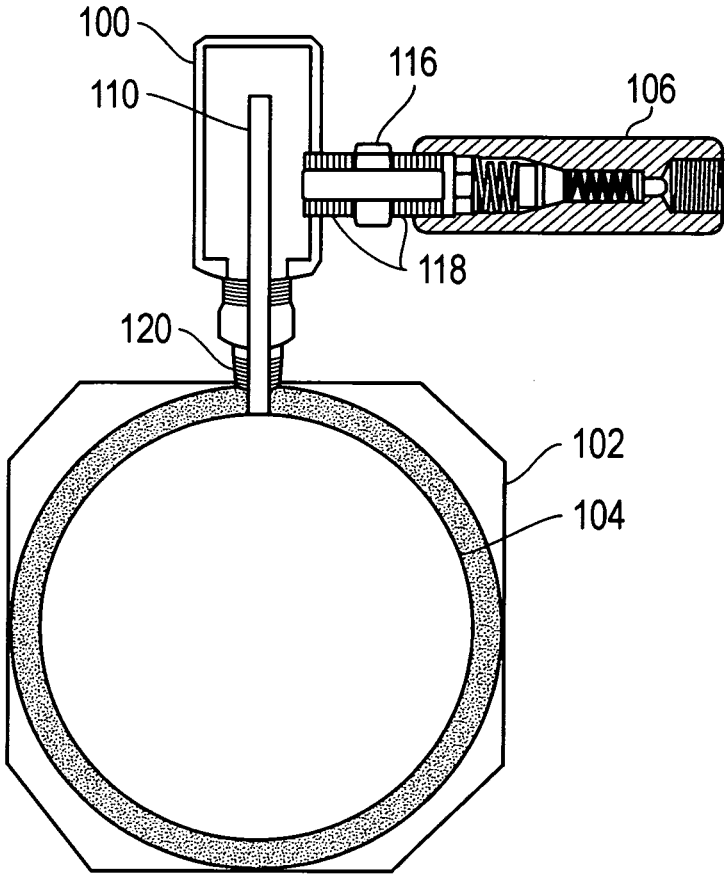
FIG. 1 (Prior Art)
FIG. 1 shows a cross sectional view of a prior art reservoir device with a check valve mounted on a CNG compressor cylinder.

Applicant has found that the prior art reservoir device shown in FIG. 1, while providing some degree of protection compared to mounting the check valve directly on the compressor, has several drawbacks.

A. Volume of Oil

The interior volume of the various check valve, reservoir, and fitting components must be filled before oil will pass through those components and lubricate the compressor. The volume of oil needed to fill the check valve cavity on the discharge end, the ¼"×¼" nipple that couples the check valve to the reservoir device, and the reservoir device void, is approximately 2.999 $cm^3$ (0.183 cubic inches). If a divider block system, such as divider block system 320 of FIG. 3A, providing the lubrication cycles every 30 seconds and has a piston sized to provide 0.098 $cm^3$ (0.006 cubic inches) per cycle, the compressor could operate for 15 minutes before lubrication is injected into the lubrication point. CNG compressors typically operate intermittently, on demand. Due to the frequent starting and stopping and the limited run times of CNG compressors during operation, this delay in providing lubrication can cause premature wear or failure of cylinder and packing components. A typical CNG compressor can start as many as 150 times each day and run for only a short period of time, such as five to fifteen minutes. This problem of delaying the delivery of lubricant is exasperated when using divider block systems 320 having longer cycle times. The combination of long cycle time of divider block 320 and the extra time required to fill the void in the reservoir device after replacement of parts on the lube system, can present a major problem in providing lubrication to the compressor components.

B. Dilution of Oil by Natural Gas

After start-up, the compressor fills the CNG storage bottles with the compressed gas to a specified pressure, typically 248.2 bar (3600 psi), and then automatically shuts down. The remaining gas in the cylinder is released ("blown down") to allow the unit to start again in an unloaded state. As the compressor cylinder compresses gas, the volume of oil in the reservoir device becomes saturated with dissolved gas. As the compressor stops and the cylinder is blown down, the dissolved gas comes out of solution because of the rapid decompressing of the oil and creates foaming of the oil (entrained air) which in turn forces out some of the oil in the reservoir device, replacing the oil with gas released from solution. This process forces the oil contained in the check valve cavity, the oil in the ¼"×¼" nipple, and the oil in the reservoir device out with the gas blown down. At start-up divider block system 320 must fill all of these voids before lubrication is introduced into the injection point to lubricate the cylinder and packing. This causes premature wear or failure of the compressor components.

C. Vibration-Induced Failures

The combined weight of the reservoir device, double female check valve, ¼"×¼" MPT nipple, and the tubing fitting shown in FIG. 1 is approximately 396.9 grams (14 ounces). The compressor experiences extreme vibration during normal operation. The vibration combined with the weight of the components causes premature failure of the ⅛" or ¼" NPT male pipe connector 120 threaded into the injection point. This failure results in compressed gas in the cylinder or packing point to immediately escape to the atmosphere creating an explosion or fire safety hazard and possible injury to operators standing near the compressor.

D. Premature Failure of Cylinders/Packing

When the NPT connector of the reservoir device cracks, the oil needed to lubricate the compressor components leaks to atmosphere with the gas and the compressor will continue to operate causing the compressor components (cylinders/packing) to suffer premature wear and failure due to lack of lubrication.

While the prior art reservoir device described above protects the check valve from the gasses in the cylinder to some extent by providing an oil barrier seal, those components suffer from the problems described in A-D above. Preferred embodiments of the invention provide a liquid seal between the check valve and the environment into which the liquid is being injected that overcomes the above problems. Below are described embodiments that provide oil head seals between the check valve and gas/debris in the cylinder.

Figure 2:
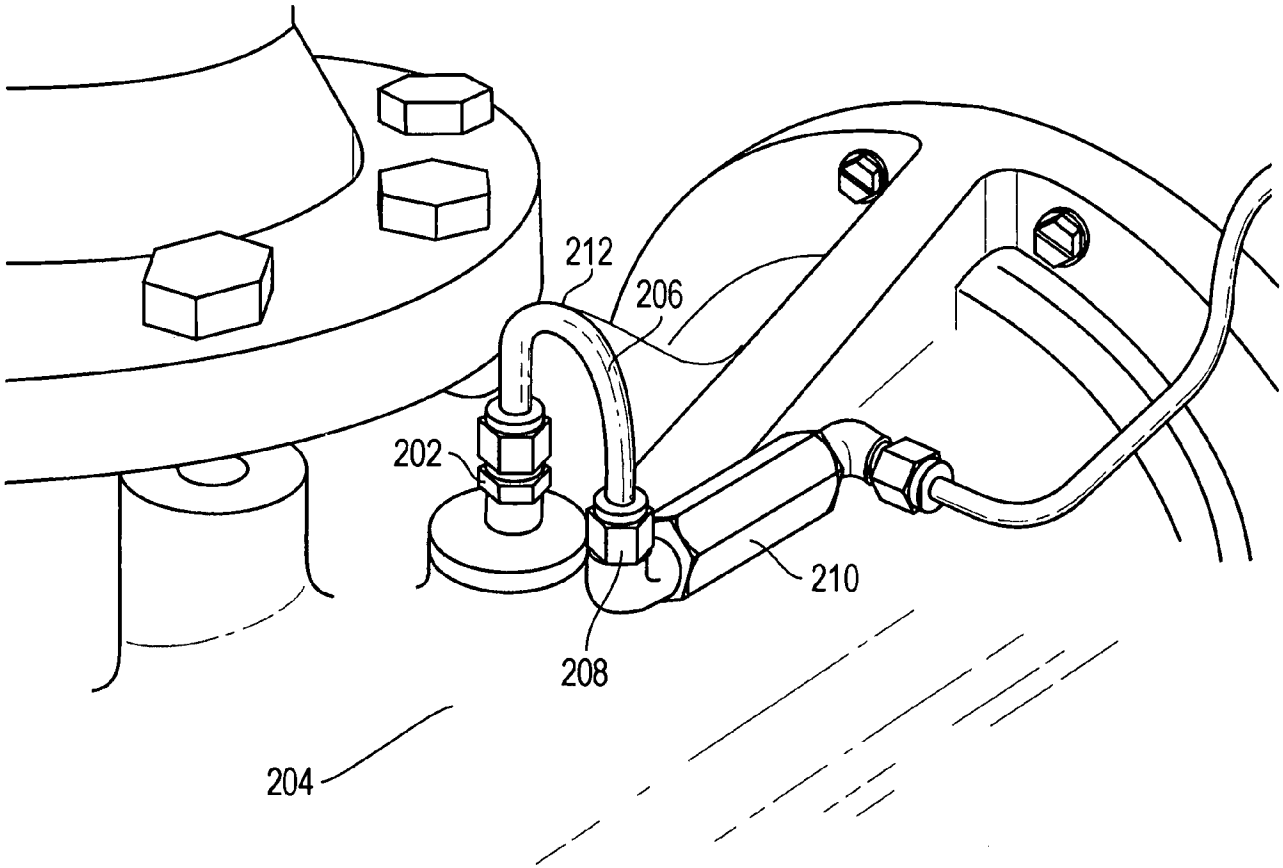
FIG. 2 shows an embodiment of the invention.

In one embodiment, shown in FIG. 2, an oil seal is provided by using standard tubing and fittings in a novel way. FIG. 2 shows a fitting 202 connected to a natural gas compressor cylinder 204. Tubing 206 runs from the fitting 202 to another fitting 208 connected to a check valve 210. A bend 212 in the tubing 206 between the injection point at the compressor cylinder 204 and the check valve 210 forms an oil seal. The embodiment of FIG. 2, while providing advantages over the prior art, has disadvantages. The extra components create additional costs, provide additional possibilities for leaks, and the additional weight, combined with vibration of the compressor, can create stress cracks in the tubing allowing hazardous gases to escape into the atmosphere.

The female-by-female check valve manufactured and installed on thousands of gas and air compressors incorporates ¼" NPS (national pipe straight) thread connections. The tube fitting and male pipe nipple used to assemble the check valve and components use NPT threads. When connecting these different types of threads, the result is that only 1½ to 2 threads are actually available to create the sealing area. Although this connection is insufficient to comply with preferred engineering practices, it is still used by many compressor manufacturers. To ensure reliable sealing between the components, users should employ industry standard NPTF (NPT female) to NPTM (NPT male) thread connections.

Figure 3A:
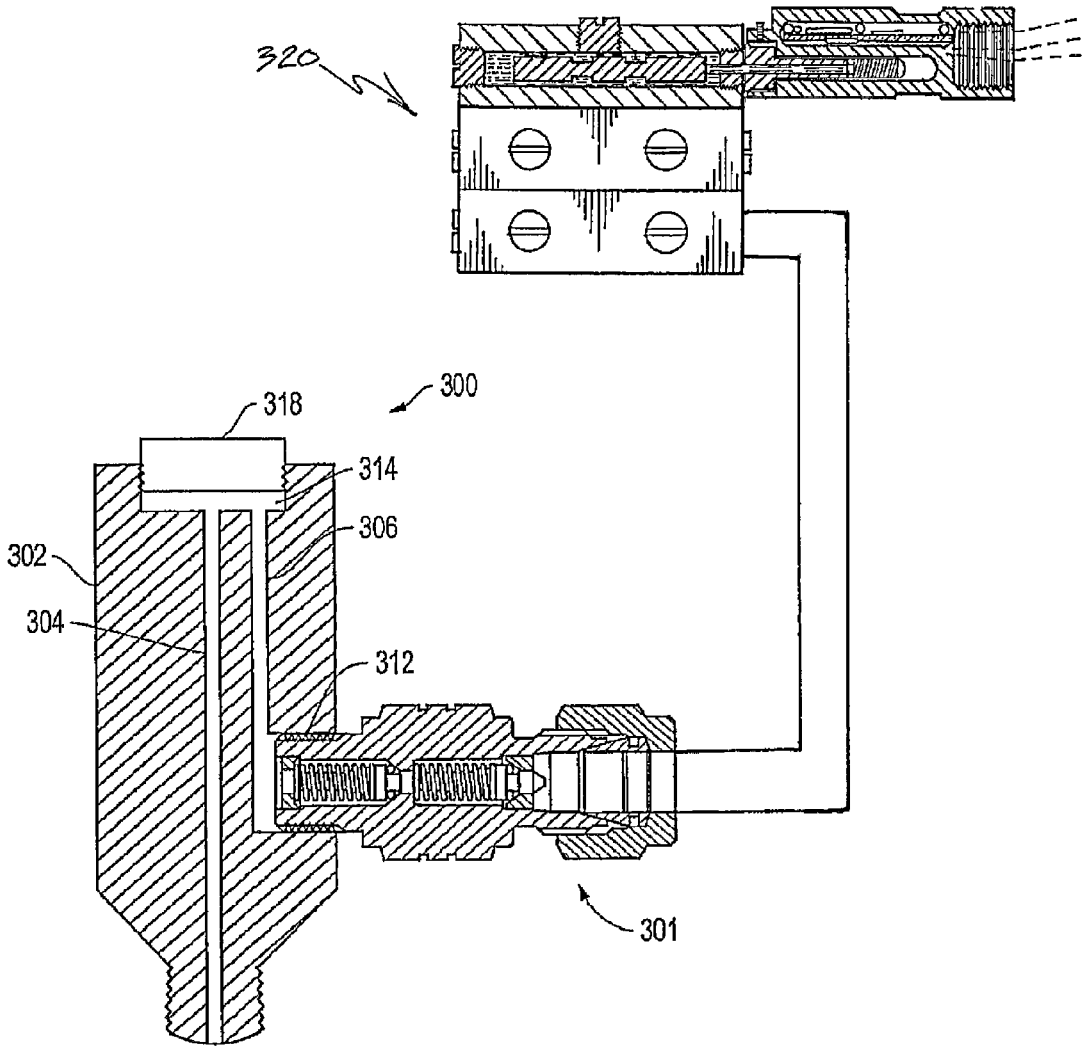
FIG. 3A shows a preferred embodiment of a check valve and check valve protection device.

FIG. 3A shows a preferred embodiment that increases reliability of check valves, protects compressor components, and provides a safer working environment. The embodiment of FIG. 3A uses an improved check valve protective device 300 (also referred to as an "oil head fitting") and an improved check valve 301. The check valve 301 and the check valve protective device 300 may be two separate devices that are connected, or they can be combined into a single unit.

Figure 4:
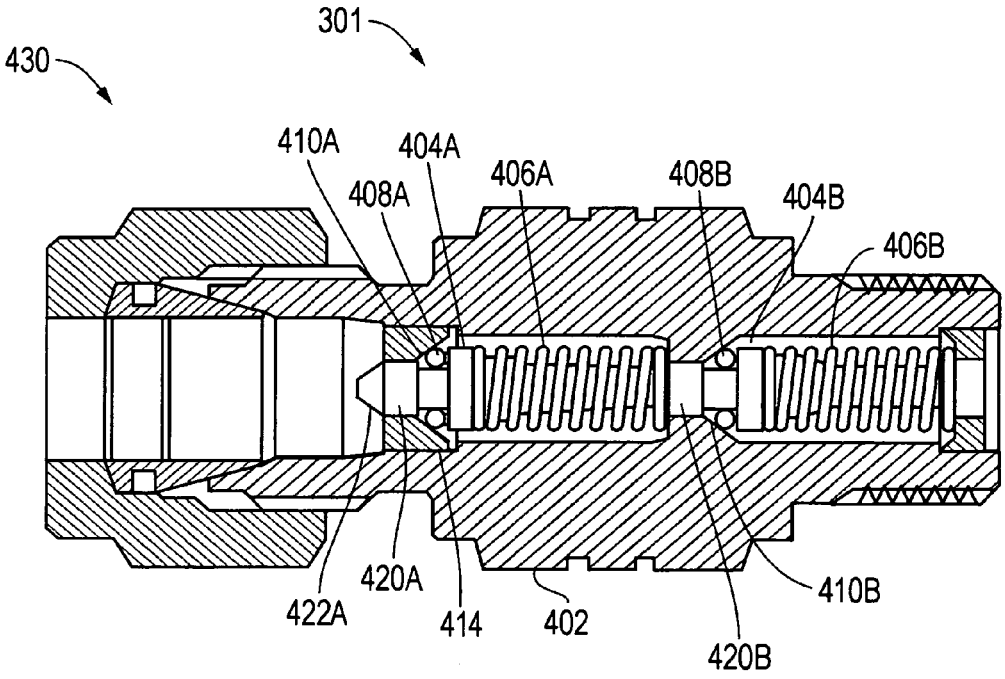
FIG. 4 shows an enlarged view of an improved check valve.

FIG. 4 shows an enlarged view of check valve 301. Check valve 301, referred to as the CCT "XD" Injection Check Valve, is preferably made from stainless steel and is lightweight to reduce failure caused by vibration. A preferred check valve 301 is rated to operate at 689.5 bar (10,000 PSI) operating pressure and a temperature of 204.44° C. (400° F.), although the operating specifications of an embodiment will, of course, depend on the application to which the valve is applied. Check valve 301 includes a valve body 402 and poppets 404A and 404B that are pressed by respective springs 406A and 406B to seal against respective O-rings seals 408A and 408B, which are positioned in tapered guides 410A and 410B, respectively. In one embodiment, tapered guide 410B is milled in the valve body 402 and tapered guide 410A is a feature of a metal insert 414. The poppets are further guided by pilot portions 420A and 420B that include tapered front portions 422A and 422B (hidden by spring 406A), which are guided into alignment by tapered guides 410A and 410B, respectively. The use of one or more tapered guides and pilots ensures that the poppets 404A and 404B are always guided to the tapered metal shoulders to seat the O-rings, thereby providing a positive seal. The double O-ring seals positioned in the tapered guides allow for a positive seal to eliminate leakage. Check valve 301 also incorporates a tubing connector 430 that is integral with the check valve to eliminate possible leak paths in the assembly, simplify installation, and reducing weight.

Check valve 301 is relatively small and light, thereby reducing or eliminating vibration-induced failures. Check valve 301 provides to the compressor industry a dependable solution to extend the longevity and reliability of divider block system injection check valves. The use of double self guiding poppets, although not required for every implementation, is preferred in most implementations to provide a sure seal.

Figure 3B:
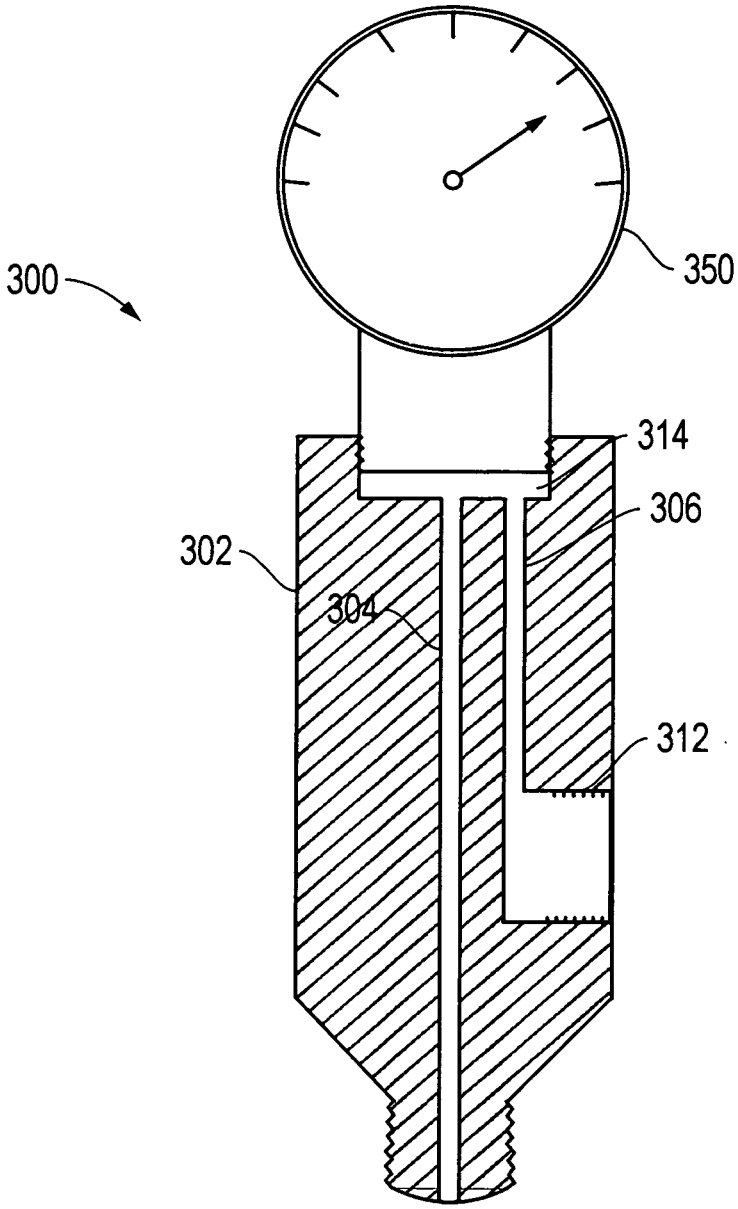
FIG. 3B shows the check valve protection device of FIG. 3A with a plug replaced by a pressure gauge.

FIG. 3B shows a preferred protective device 300 that provides an oil head to seal and protect the check valve from heated gas and from contamination in the gas stream. A preferred check valve protection device minimizes the amount of oil required to fill the device to reduce the effects of gas saturation and to reduce the time required to inject lubricant to the cylinder or packing. The preferred protection device is rated at 689.5 bar (10,000 psi) operating pressure and is light weight to eliminate vibration-induced failures. The device is readily connected to the check valve with a minimum of fittings, or the device is integral with the check valve. Also, a preferred device enables installation of a pressure gauge at the injection point to check actual injection pressure for field troubleshooting.

Check valve protection device 300 includes a solid body 302 having a first passage 304 that provides fluid to the device (not shown) to which the fluid is to be delivered and a second passage 306 receiving the fluid from a check valve 301, which screws into a first threaded cavity 312 in solid body 302. A second threaded cavity 314 provides a fluid connection between passage 304 and passage 306, the second threaded cavity being sealed by a plug 318. Plug 318 is screwed into the second threaded cavity 314 to leave just sufficient space in the second threaded cavity 314 to allow fluid to flow readily from passage 304 to passage 306 through the second threaded cavity 314. Plug 318 can be preferably removed to install a pressure gauge to check actual injection pressure for field troubleshooting. This aspect is novel and is provided to enable troubleshooting of the compressor cylinder and the lubrication system. The industry has never had an easy way to check the system pressure at the injection point, and this design makes a pressure check possible. FIG. 3B shows check valve protection device 300 with the plug 318 removed and a pressure gauge 350 attached.

While the embodiment shown in FIGS. 3A and 3B is relatively simple to manufacture, skilled persons will recognize that the design, such as the path between the check valve and the device to which fluid is to be delivered, could be altered without departing from scope of the invention. For example, rather than passages 304 being centered, passages 304 and 306 could be offset from the longitudinal axis of solid body 302, and plug 318 could be designed with a wide, circumferential ridge that reduces the volume of the cavity along an annulus outside the passages. In another example, second threaded cavity 314 could be eliminated. Passage 306 could then be drilled from the top or bottom and sealed with a plug, and then a third passage drilled from the side of body 302 to connect passage 304 and 306, with the third passage also sealed by a plug. The embodiment of the check protection device shown in FIG. 3A will provide protection to the check valve when mounted in any orientation. When mounted with the check valve sticking up vertically from the check valve protection device 300, the oil seal is provided in most embodiments by oil retained in the passages 304 and 306 by surface tension, because the passages 304 and 306 are sufficiently narrow and the surface tension is sufficiently high. In embodiments in which the surface tension is not sufficiently high and it is desired to orient the assembly with the check valve vertical, skilled persons could readily add an additional passage or alter existing passages to provide an oil head in any direction.

Figure 5:
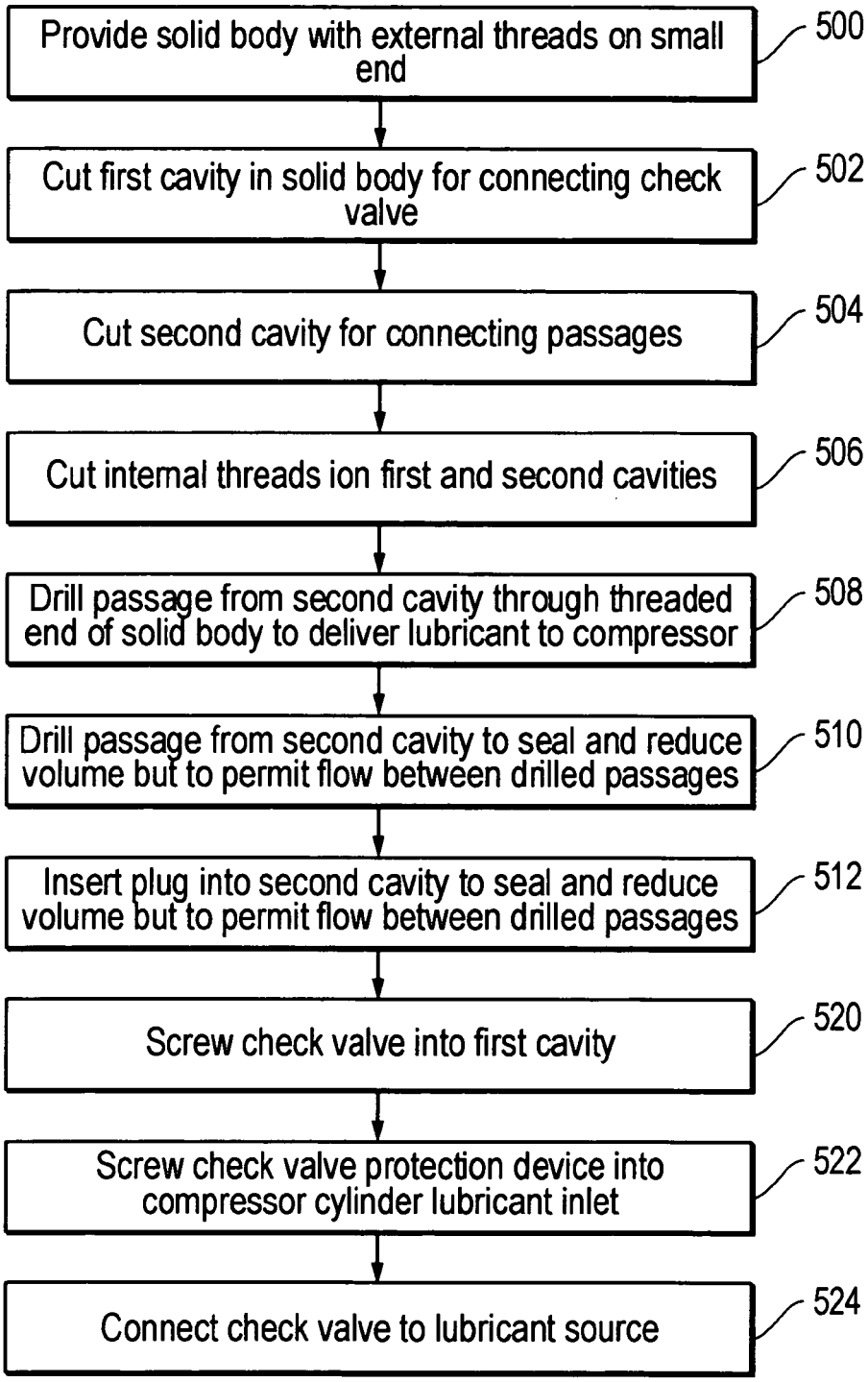
FIG. 5 is a flow chart showing a method of manufacturing the check valve protection device of FIG. 3.
Figure 6:
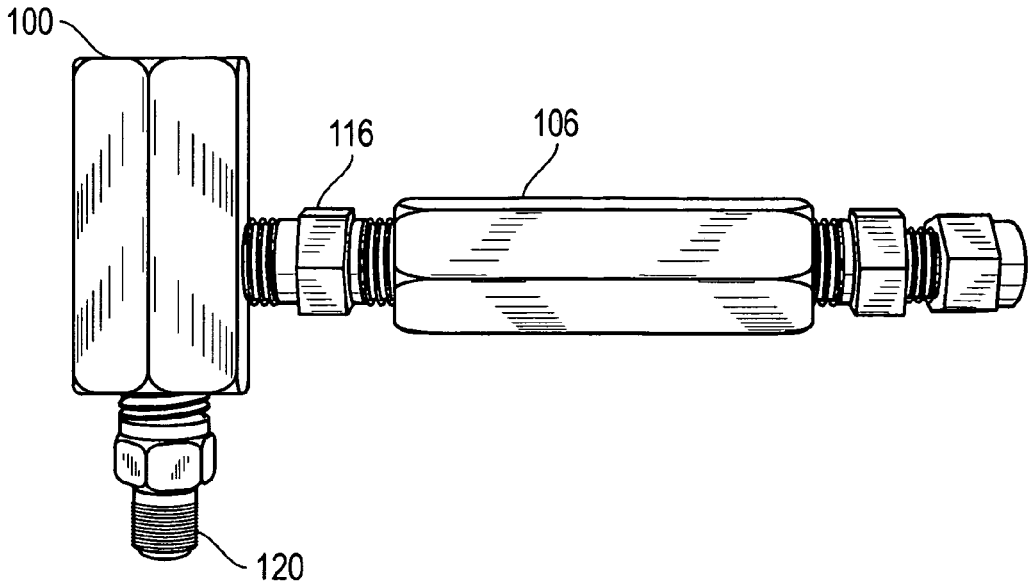
FIG. 6 (Prior Art)
FIG. 6 shows a prior art reservoir and check valve.
Figure 7:
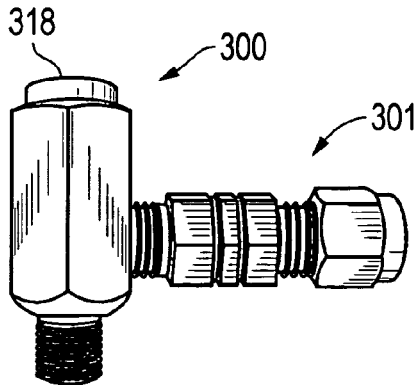
FIG. 7 shows a reservoir and check valve embodiment of the invention.

FIG. 5 shows a method of making and using a preferred check valve protection device. The steps can also be performed in a different order from the order shown. In step 500, solid body 302 is provided, with external threads cut in the portion extending from a taper at one end. In step 502, first cavity 312 is cut in solid body 302 for attaching the check valve. In step 504, second cavity 314 is cut for connecting internal passages to be drilled. In step 506, internal threads are cut in the first and second cavities. In step 508, passage 304 is drilled from the second cavity 314 through the threaded end of body 302. In step 510, passage 306 is cut from second cavity 314 to intersect first cavity 312. In step 512, plug 318 is screwed into cavity 314 sufficiently far to seal the cavity and to reduce the remaining volume of the cavity, but not so far as to impede the flow of lubricant from passage 304 to 306. The method of making the protection device that includes cutting a second cavity and threading a portion of it has the benefit of providing a convenient place to plug in a pressure gauge to monitor the lubrication system pressure at the injection point. In step 520, check valve 301 is screwed into cavity 312. In step 522, the check valve protection device 300 with check valve 301 is screwed into a compressor cylinder. In step 524, the check valve is connected to the lubrication source.

The total weight of the combination of check valve 301 and check valve protection device 300 shown in FIG. 3A is about 113.4 grams (4 oz). In other preferred embodiments, the combination of check valve and check valve protection device weigh less than 283.5 grams (10 oz), less than 226.8 grams (8 oz), and most preferably less than 141.75 grams (5 oz). The light weight reduces the likelihood of failure caused by vibration.

The embodiment of FIG. 3A has a fill capacity of about 0.164 $cm^3$ (0.010 $in^3$), which requires less than two cycles of a number 6 (0.098 $cm^3$ (0.006 $in^3$)) piston in divider block 320 to deliver lubrication at the injection point. The fill capacity, that is, the volume required to fill the check valve protection device before lubricant is delivered to the compressor, can vary with the embodiment, and will typically depend on the size of the lubrication system. That is, lubrication systems using a larger pump that deliver more lubricant per cycle can have a larger fill capacity for the protection device, without causing an excessive delay of the lubricant injection. A preferred check valve protection device for a typical system has an internal volume of preferably less than 1.966 $cm^3$ (0.12 cubic inches), less than 1.639 $cm^3$ (0.10 cubic inches), less than 0.819 $cm^3$ (0.050 cubic inches), less than 0.492 $cm^3$ (0.030 cubic inches), and more preferably approximately 0.164 $cm^3$ (0.01 cubic inches) or less. The preferred fill capacity will vary depending on the size of the lubrication system. A preferred check valve protection device requires less than 15 cycles of the lubricant pressurization device, such as divider block 320, to fill the device. A more preferred device requires less than 10 cycles, less than 7 cycles, less than 5 cycles, less than 3 cycles, or less than 2 (all for example, of a No. 6 or other piston) to fill the device and begin delivering fluid to the injection point.

The invention is not limited to any particular arrange of internal passages. A preferred embodiment provides a small fill capacity, regardless of the design of the device, so that the lubricant is delivered rapidly to the lubricated system and the check valve or other device is protected. A preferred protection device works while mounted in any orientation on the compressor. That is, an oil head remain between the compressor and the check valve in any orientation.

Figure 8A:
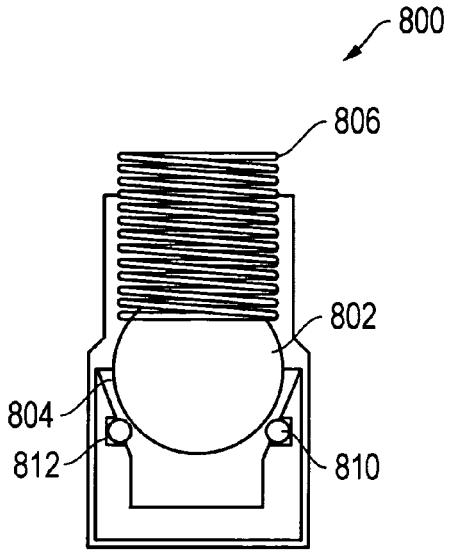
FIG. 8A shows a preferred embodiment of an improved check valve in an open position.
Figure 8B:
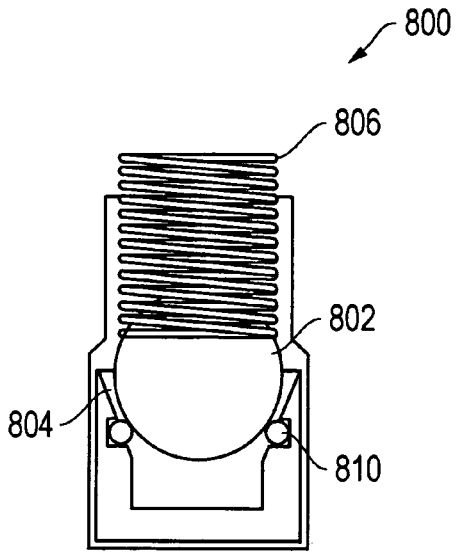
FIG. 8B shows the check valve of FIG. 8A with the ball sealed against the o-ring.
Figure 8C:
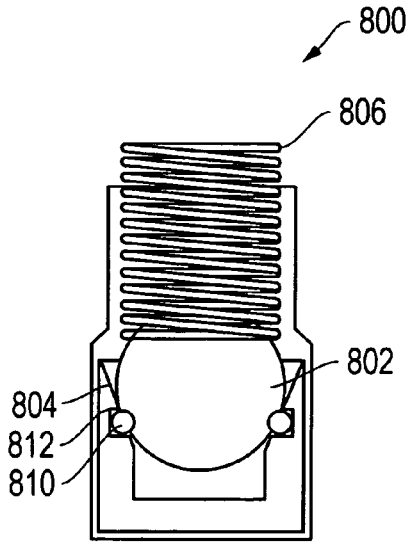
FIG. 8C shows the check valve of FIG. 8A with the ball sealed against a metal surface.

FIGS. 8A-8C show a part of another preferred embodiment of a check valve 800. Check valve 800 includes a ball 802, rather than the flat poppet 404A or 404B of check valve 301 of FIG. 4. Ball 802 is preferably made from stainless steel. Ball 802 is positioned in a tapered passage 804 and is pressed by a spring 806 into an o-ring 810 positioned in a groove 812. In FIG. 8A, the ball 802 is not seated and valve 800 is open. As shown in FIG. 8B, at low or medium pressure, the ball will seal against the o-ring 810. As shown in FIG. 8C, at higher pressures, ball 802 can compress the o-ring 810 and form a metal-to-metal seal with tapered passage 804 to provide a back-up sealing surface. A preferred embodiment of a check valve uses two of the assemblies shown in FIG. 8A-8C in series, similar to the double valve concept shown in FIG. 4.

With an operating pressure rating of about 689.5 bar (10,000 PSI) and operating temperature rating of about 204.44° C. (400° F.), the check valve and protection device combination of FIG. 3A combination addresses the need for dependable check valve operation, protection of compressor components, and operator safety. While a check valve having the features shown in FIG. 4 or FIGS. 8A-8C is preferred, any check valve can be used with the check valve protection device 300. Also, a check valve having the improvements shown in FIG. 4 or FIGS. 8A-8C can be used without a check valve protection device, in less harsh environments. Moreover, the check valve protection device can be used to protect other equipment besides a check valve.

In this embodiment, the o-ring provides the primary sealing surface. If the o-ring should fail, the ball provides a metal-to-metal back-up seal. The metal-to-metal sealing surface reduces or eliminates problems at elevated temperatures or with fluids that would not be compatible with the o-ring elastomer in the double poppet of FIG. 4.

This embodiment provides several additional advantages over prior art check valves. It eliminates the need to machine small poppets and can use commercially available balls and springs. The ball 802 is easily guided onto the o-ring surface and does not require precise positioning on the o-ring to seal. The o-ring is typically stationary in its seat, and will not expand due to pressure. The o-ring provides a very effective sealing surface for low pressure applications and is forgiving should debris become caught between the ball and the o-ring seal; the ball can crush small debris and continue to seal. If the o-ring loses its sealing ability due to failure caused by temperature, fluid compatibility issues, excessive pressure, or heat, the ball will travel downward compressing the o-ring and contact the metal surface of the seat. This provides a metal-to-metal back-up sealing surface.

The system describes herein provides the compressor industry with a dependable solution to extend the longevity and reliability of divider block system injection check valve.

The invention includes more than one novel and inventive aspect, and not all implementations will require all aspects to be combined in each implementation. Although the present invention and its advantages have been described in detail, it should be understood that various changes, substitutions and alterations can be made herein without departing from the spirit and scope of the invention as defined by the appended claims. The invention is not limited to the use of check valves in CNG compressors, but is useful on all systems, such as compressors, and in any environment where contamination or corrosion of equipment, is possible.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim as follows:

1. In a lubrication system for a natural gas compressor, in which a lubricant is intermittently injected into a compressor cylinder through a check valve that prevents natural gas from entering the lubrication system, the improvement comprising a protection device positioned between the compressor cylinder and the check valve to maintain an oil barrier to prevent natural gas from fouling the check valve, the protection device having a fill capacity of less than 1.966 $cm^3$ (0.12 cubic inches), the protection device further comprising:

a first bore and a second bore cut into a solid plug having a threaded end for attaching to the compressor cylinder, the first bore leading to the compressor cylinder and the second bore intersecting transversely with a threaded third bore for attaching the check valve; and a fourth bore intersecting with and providing a connection between the first and second bores, the fourth bore being partially plugged to maintain lubricant within the device while allowing lubricant to flow between the first and second bores.

2. The device of claim 1 in which the protection device maintains an oil barrier regardless of the orientation of the device on the compressor when the compressor is in operation.

3. The device of claim 1 in which the protection device includes a path for lubricant, a direction of the path changing within the protection device to trap oil between the check valve and the compressor thereby providing an oil seal between the compressor cylinder and the check valve.

4. The device of claim 1 in which the device has a fill capacity of less than 1.639 $cm^3$ (0.1 cubic inches).

5. The device of claim 1 in which the device has a fill capacity of less than 0.819 $cm^3$ (0.05 cubic inches).

6. The device of claim 1 in which the device has a fill capacity of less than 0.328 $cm^3$ (0.02 cubic inches).

7. The device of claim 1 in which the first and second bores are essentially parallel.

8. The device of claim 1 in which the first and second bores and the fourth bore each have a respective volume, and wherein the volume of the partially plugged fourth bore between the first and second bores is less than twice the combined volumes of the first and second bores.

9. A device to provide a seal between an injection point of a lubricated system and a check valve connected to a lubricant pressurization device, comprising:

a solid material having a longitudinal axis, first and second ends along the longitudinal axis, and external threads on the first end for connecting to a compressor;

a connecting bore penetrating and extending into the solid material from the second end;

an inlet bore for attaching the check valve;

an outlet located on said first end for attaching to the compressor;

first and second lubricant passage bores, the first lubricant passage bore extending from the connecting bore to the outlet, the second lubricant passage bore extending from the connecting bore to intersect transversely with the inlet bore;

the connecting bore permitting lubricant to flow between the inlet bore and the outlet through the first and second lubricant passages;

wherein the combined volume of the first lubricant passage bore, the second lubricant passage bore, and the connecting bore is less than 1.966 $cm^3$ (0.12 cubic inches).

10. The device of claim 9 in which the first and second lubricant passage bores are substantially parallel to the longitudinal axis.

11. The device of claim 9 in which the inlet bore is substantially perpendicular to the longitudinal axis.

12. The device of claim 9 in which the lubricated system is a natural gas compressor.

13. The assembly of claim 12 in which the check valve is a double poppet check valve.

14. An assembly for introducing lubricant into a natural gas compressor, comprising:

the device in accordance with claim 9; and the check valve connected to the inlet bore.

15. The assembly of claim 14 further comprising a divider block for distributing oil to the check valve.

16. A device to provide a seal between a check valve in a lubrication system and a compressor when a lubricant is passed through the device from the check valve to the compressor, the device comprising:

a body formed from a material, the body having a longitudinal axis, first and second ends along the longitudinal axis, an outlet located on said first end for connecting to the compressor, and an inlet for connecting to a check valve connected to a cycling lubricant pressurization device in fluid communication with the device that supplies no more than 0.098 $cm^3$ (0.006 cubic inches) of lubricant to the device each cycle;

a first lubricant passage bore extending from the outlet to a base of a fluid reservoir within the body;

a second lubricant passage bore extending from the inlet to the base of the fluid reservoir;

the two lubricant passage bores separated by the body material and fluidly connected via the fluid reservoir so that lubricant pumped through the check valve is passed to the compressor; and the capacity of the fluid reservoir and the first and second lubricant passage bores requiring less than 10 cycles of the lubricant pressurization device to be filled.

17. The device of claim 16 in which the fill capacity of the fluid reservoir and the first and second lubricant passage bores is less than 0.164 $cm^3$ (0.01 cubic inches).

18. The device of claim 16 in which the second lubricant passage bore having a diameter small enough that the surface tension of lubricant in the second lubricant passage bore will maintain an oil barrier between the compressor and the check valve when the compressor is in operation, regardless of the orientation of the device on the compressor.

19. The device of claim 16 in which the first and second lubricant passage bores have substantially the same diameters.

20. The device of claim 16 in which the fluid reservoir has a removable plug sealing the reservoir from the exterior of the device.

21. The device of claim 20 in which the plug comprises a pressure gauge for monitoring lubrication system pressure.

* * * * *